US006450252B1

(12) United States Patent
Liao

(10) Patent No.: US 6,450,252 B1
(45) Date of Patent: Sep. 17, 2002

(54) OIL CHANGING UNIT HAVING HEAT EXCHANGER

(75) Inventor: Po-Lin Liao, Taichung (TW)

(73) Assignee: Lih Yann Co., Ltd., Taichung (TW)

( * ) Notice: Subject to any disclaimer, the term of this patent is extended or adjusted under 35 U.S.C. 154(b) by 0 days.

(21) Appl. No.: 09/930,602

(22) Filed: Aug. 15, 2001

(51) Int. Cl.[7] ..... F28D 7/10; E28E 9/22
(52) U.S. Cl. ..... 165/154; 165/155; 165/159
(58) Field of Search ..... 165/154, 155, 165/158, 159, 916

(56) References Cited

U.S. PATENT DOCUMENTS 4,862,955 A * 9/1989 Itakura ..... 165/155
5,649,589 A * 7/1997 Carpentier ..... 165/154
5,746,170 A * 5/1998 Moriya ..... 123/196 AB
6,151,891 A * 11/2000 Bennett ..... 60/298
6,158,503 A * 12/2000 Gille et al. ..... 165/132
6,263,962 B1 * 7/2001 Komoda et al. ..... 165/916

* cited by examiner

*Primary Examiner*—Henry Bennett
*Assistant Examiner*—Tho V Duong

(57) ABSTRACT

An oil changing unit comprises a base having a disk configuration and forming a socket at a center thereof. The base further includes a manifold block thereunder and a first circular ridge formed on the base and surrounding said socket and a second circular ridge formed on a peripheral of the base. A first tube is securely assembled to the socket and having an orifice in a wall thereof. A first cylinder is attached to the first circular ridge and encloses the first tube therein. The first cylinder includes a first lid enveloped and secured onto the first tube and tightly sealing an upper end thereof such that the orifice of the first tube is located within the first cylinder. A second cylinder is attached to the second circular ridge and encloses the first tube therein and includes a second lid enveloped and secured onto the first tube and tightly sealing an upper end. Wherein fresh engine oil and recycled engine oil are directed into the first and second cylinders, respectively, such that the fresh engine oil can be heated by the recycled engine oil.

5 Claims, 5 Drawing Sheets

OIL CHANGING UNIT HAVING HEAT EXCHANGER

FIELD OF THE INVENTION

The present invention relates to an oil changing unit, and more particularly to an oil changing unit having heat exchanger in which refilled oil can be heated up by the recycled oil before the refilled oil is poured into the engine.

DESCRIPTION OF THE PRIOR ART

In order to quickly and efficiently change engine oil for vehicle, a conventional oil changing unit can recycle the used engine oil with new oil efficiently and automatically within a certain short period of time. In doing so, the used engine oil in the engine is pumped out firstly, then a cleaning agent is directed into the engine to cleanse and flush the engine and remove any carbon residues stuck thereto. Finally, new engine oil is poured into the engine. This really save a plenty of time for the customer.

As it can be readily understood, the oil change procedure is conducted right after the engine is stalled while the engine and its parts therein are still very hot. As the new engine oil is stored in the room temperature, the refilled engine oil will serve as a coolant to the parts within the engine. The moving parts within the engine can easily be damaged because it is a "sudden quenched". If this situation is not properly taken care, the lifespan of the parts could be shortened.

SUMMARY OF THE INVENTION

An object of this invention is to provide a heat exchanger for use with an engine oil changing unit in which the refilled oil is properly heated so as to reduce sudden quench effect to the moving parts within engine.

In order to achieve the object set forth, an oil changing unit in accordance with the present invention comprises a base having a disk configuration and forming a socket at a center thereof. The base further includes a manifold block thereunder and a first circular ridge formed on the base and surrounding said socket and a second circular ridge formed on a peripheral of the base. A first tube is securely assembled to the socket and having an orifice in a wall thereof. A first cylinder is attached to the first circular ridge and encloses the first tube therein. The first cylinder includes a first lid enveloped and secured onto the first tube and tightly sealing an upper end thereof such that the orifice of the first tube is located within the first cylinder. A second cylinder is attached to the second circular ridge and encloses the first tube therein and includes a second lid enveloped and secured onto the first tube and tightly sealing an upper end. Wherein fresh engine oil and recycled engine oil are directed into the first and second cylinders, respectively, such that the fresh engine oil can be heated by the recycled engine oil.

BRIEF DESCRIPTION OF DRAWINGS

Other objects and further features of the present invention will be apparent from the following detailed description when read in conjunction with the accompanying drawings, in which.

DESCRIPTION OF THE PREFERRED EMBODIMENT

Figure 1:
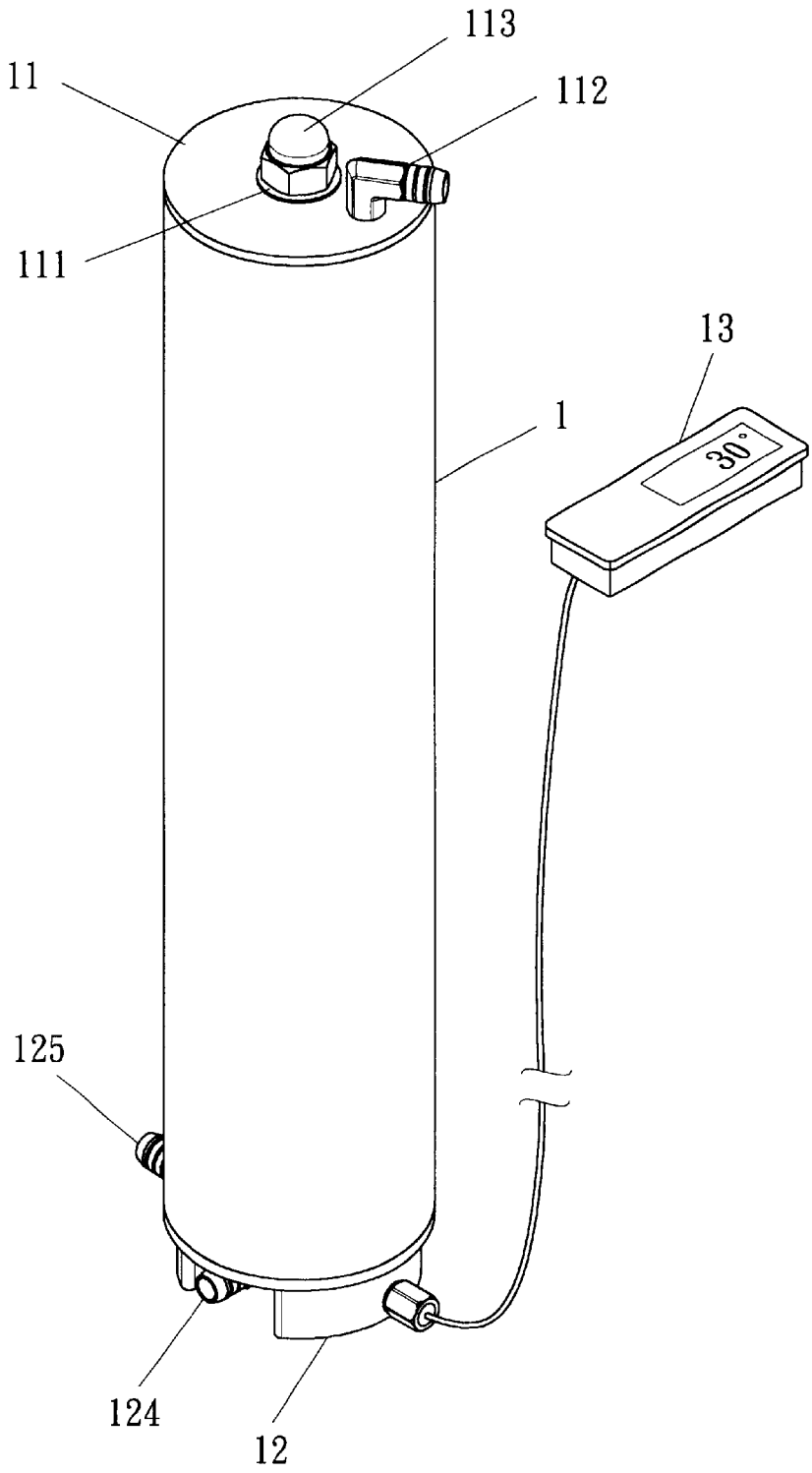
FIG. 1 is a perspective view of a heat exchanger for use with an engine oil changer.
Figure 2:
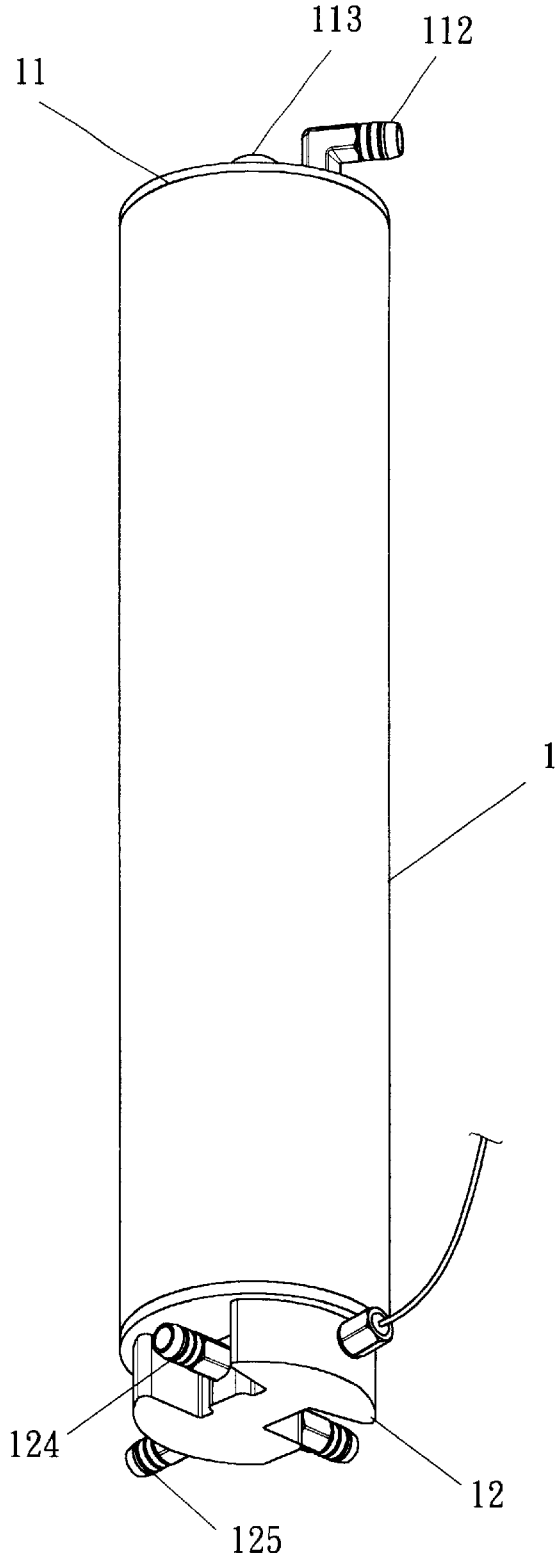
FIG. 2 is similar to FIG. 1 taken from a bottom thereof.
Figure 3:
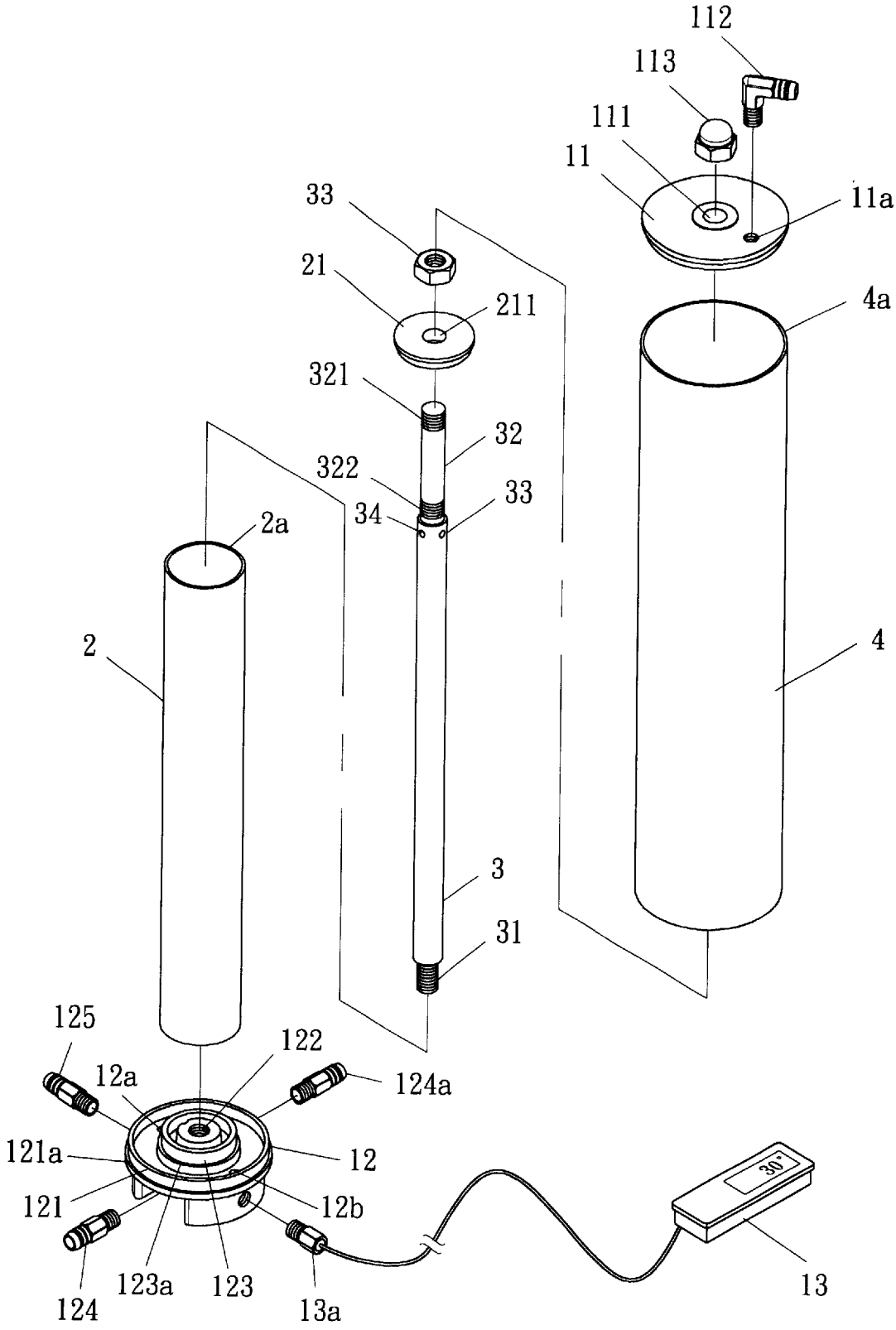
FIG. 3 is an exploded view of FIG. 1.
Figure 4:
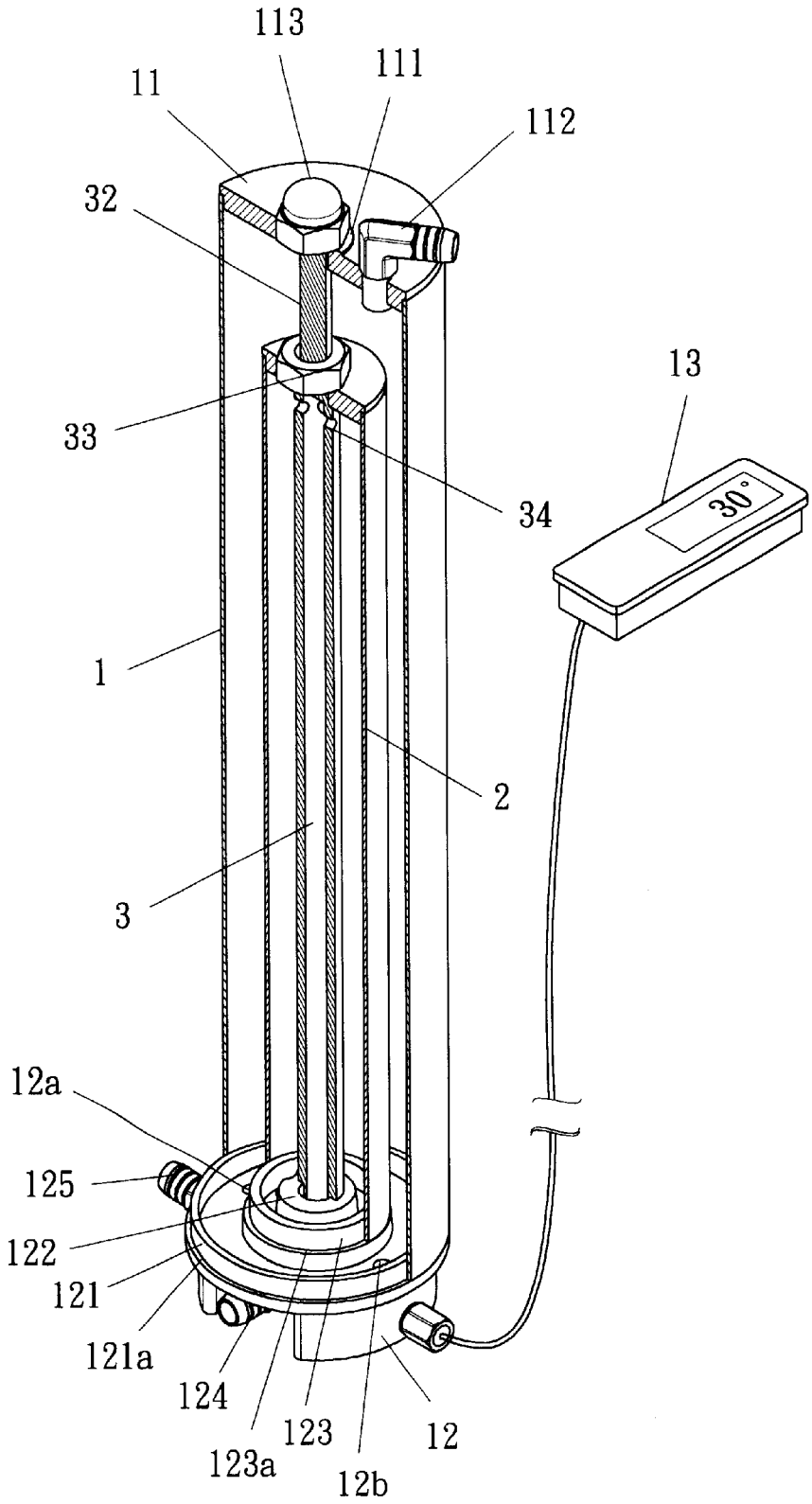
FIG. 4 is a partial cross sectional view showing internal configuration of the heat exchanger.

Referring to FIGS. 1 to 4, a heat exchanger 1 in accordance with the present invention generally includes a base

12 having a disk configuration and forming a socket 122 at a center thereof. The base 12 further includes a manifold block 12*a* thereunder and a first circular ridge 123 formed on the base 12 and surrounding said socket 122 and a second circular ridge 121 formed on a peripheral of the base 12. The first ridge 123 further forms a first shoulder 123*a*, while the second ridge 121 includes a second shoulder 121*a* as well. The base 12 further defines first and second holes 12*b*, 12*c*.

The base 12 further forms a manifold block 12*a* on which fresh engine inlet nozzle 124, and fresh engine oil outlet 124*a*, recycled engine oil nozzle 125, and temperature pick up nozzle 13*a* are attached thereto. The temperature pick up nozzle 13*a* further includes a thermometer 13 for picking up temperature readings.

A first tube 3 is securely assembled to the socket 122 and having orifices 33, 34 in a wall thereof. The first tube 3 has a threaded portion at a lower end thereof for tightly secured within the socket 122. The first tube 3 further includes a first retaining thread 322 located above the orifices 33, 34. An extension 32 extends from the retaining thread 322, and has a threaded end 321 thereof.

A first cylinder 2 is attached to the first shoulder 123*a* of the first circular ridge 123 and encloses the first tube 3 therein. The first cylinder 2 includes a first lid 21 enveloped and secured onto the first tube 3 and tightly sealing an upper end 2*a* thereof such that the orifices 33, 34 of the first tube 3 is located within the first cylinder 2. The first lid 21 includes a through hole 211 in which the extension 322 of the first tube 3 extends therethrough. A nut 23 is used to secure the first lid 21 to the upper end 2*a*. The nut 23 is securely locked to the retention portion 322 of the first tube 3.

A second cylinder 4 is attached to the second shoulder 121*a* of the second circular ridge 121 and encloses the first cylinder 2 therein and includes a second lid 11 enveloped and secured onto the threaded end 321 of the extension 32 of the first tube 3 and tightly sealing an upper end 4*a* of the second cylinder 4. The second lid 11 is sealed to the upper end 4*a* of the second cylinder 4 by a nut 113. In addition, the second lid 11 defines also a hole 11*a* in which an outlet 112 is attached thereto.

The flow path of the recycled engine oil flows through the system by firstly entering the nozzle 125, then into the second cylinder 4 surrounding the entire first tube 2 through the holes 12*b*, 12*c* on the base 12, and finally flows out the second cylinder 4 through the outlet nozzle 112 located on the second lid 11. While the fresh engine oil flows in the system from the inlet nozzle 124, then the first tube 3 and into the first cylinder 2 through the orifices 33, 34, and finally flows out the system through the outlet nozzle 124*a*.

When the recycled engine oil and fresh engine oil are with the system simultaneously, heat exchange will occur therebetween. The heat carried by the recycled engine oil will be properly transferred to the fresh engine oil thereby heating up the fresh engine oil. By this arrangement, the heated fresh engine oil will not create a sudden quench to the moving parts within the engine.

Figure 5:
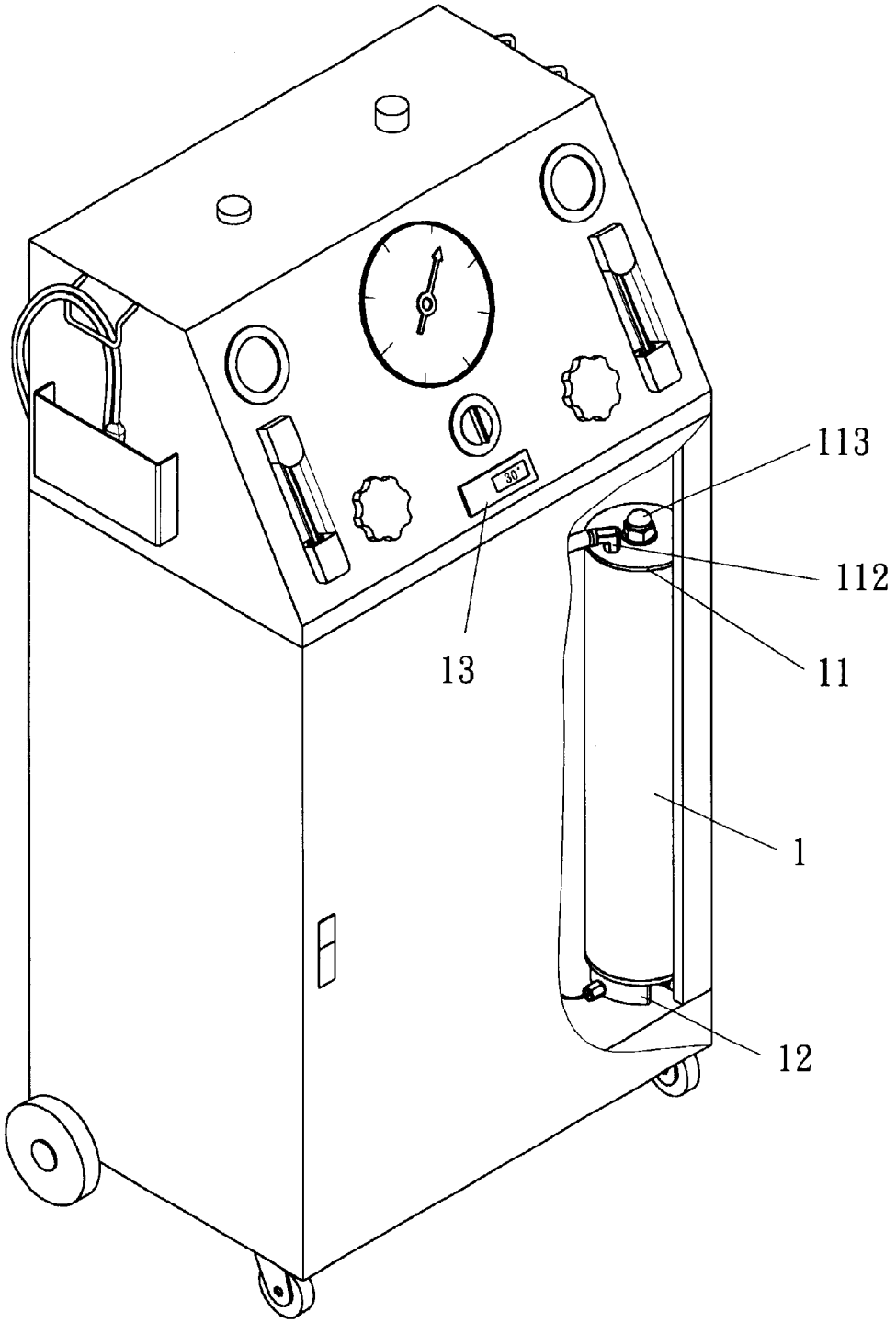
FIG. 5 is the engine oil changing unit.

FIG. 5 is an oil exchanger incorporated with the heat exchanger in accordance with the present invention. The heat exchanger 1 is installed in a housing having rollers mounted thereon (not labeled). By the provision of the heat exchanger, the heat contained within the recycled engine oil can be effectively used to heat up the fresh engine oil.

It will be understood that the invention may be embodied in other specific forms without departing from the spirit or central characteristics thereof. The present example and embodiment, therefore, is to be considered in all respects as illustrative and not restrictive, and the invention is not to be limited to the details given herein.

I claim:

1. A heat exchanger for use with an oil changing unit, comprising:

a base having a disk configuration and forming a socket at a center thereof, said base further formed with manifold block thereunder, a first circular ridge formed on the base and surrounding said socket, and a second circular ridge formed on a peripheral of the base;

a first tube securely assembled to the socket and having an orifice in a wall thereof;

a first cylinder attached to the first circular ridge and enclosing the first tube therein, the first cylinder including a first lid enveloped and secured onto the first tube and tightly sealing an upper end thereof such that the orifice of the first tube is located within the first cylinder; and a second cylinder attached to the second circular ridge and enclosing the first tube therein, the second cylinder including a second lid enveloped and secured onto the first tube and tightly sealing an upper end.

2. The heat exchanger as recited in claim 1, wherein the first cylinder is filled with fresh engine oil which is refilled through the first tube.

3. The heat exchanger as recited in claim 1, wherein the second cylinder is filled with recycled engine oil.

4. The heat exchanger as recited in claim 1, wherein the manifold block includes fresh engine oil inlet in communication with the first tube, and a fresh engine oil outlet draining heated fresh engine oil.

5. The heat exchanger as recited in claim 1, wherein the manifold block includes a recycled engine oil inlet in communication with inside of the second cylinder, and an outlet defined on the second lid of the cylinder.

* * * * *